United States Patent [19]

Villa

[11] 4,357,972

[45] Nov. 9, 1982

[54] WATER GLASS FILLER

[75] Inventor: Joseph N. Villa, Freehold, N.J.

[73] Assignee: Standard-Keil Hardware Manufacturing Company, a Division of Buildex Incorporated, Del.

[21] Appl. No.: 112,885

[22] Filed: Jan. 17, 1980

[51] Int. Cl.[3] ..... B65B 3/36

[52] U.S. Cl. ..... 141/351; 251/66; 251/156

[58] Field of Search ..... 141/362, 351, 86, 87, 141/88, 352, 353, 354, 355, 356, 357, 358, 359, 360, 361; 251/66, 90, 92, 156; 137/495

[56] References Cited

U.S. PATENT DOCUMENTS

| | | | |
|---|---|---|---|
| 702,680 | 6/1902 | Sparemaker | 251/156 |
| 1,107,022 | 8/1914 | Block | 251/66 |
| 2,940,483 | 6/1960 | Mossberg | 141/362 |
| 4,111,243 | 9/1978 | Fetterman | 141/362 |

*Primary Examiner*—Houston S. Bell, Jr.

*Attorney, Agent, or Firm*—Blum, Kaplan, Friedman, Silberman & Beran

[57] ABSTRACT

A water glass filler allows single-handed operation for either flow-on-demand or continuous flow operation. Manual actuation of a control button, using the same hand which concurrently holds the glass against a swing arm, changes on-demand flow into continuous flow. Continuous flow terminates on further actuation and release of the swing arm. Actuation of the control button drives a spring-loaded latch into a socket in the swing arm, and the water valve spring maintains this condition until the control button latch is released.

12 Claims, 7 Drawing Figures

FIG. 2
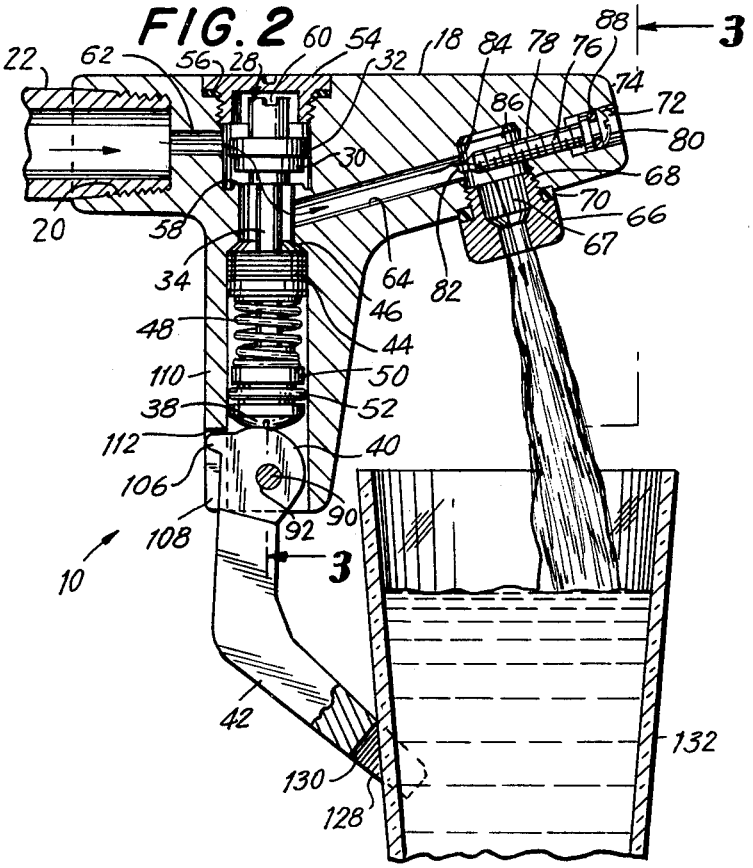
FIG. 5
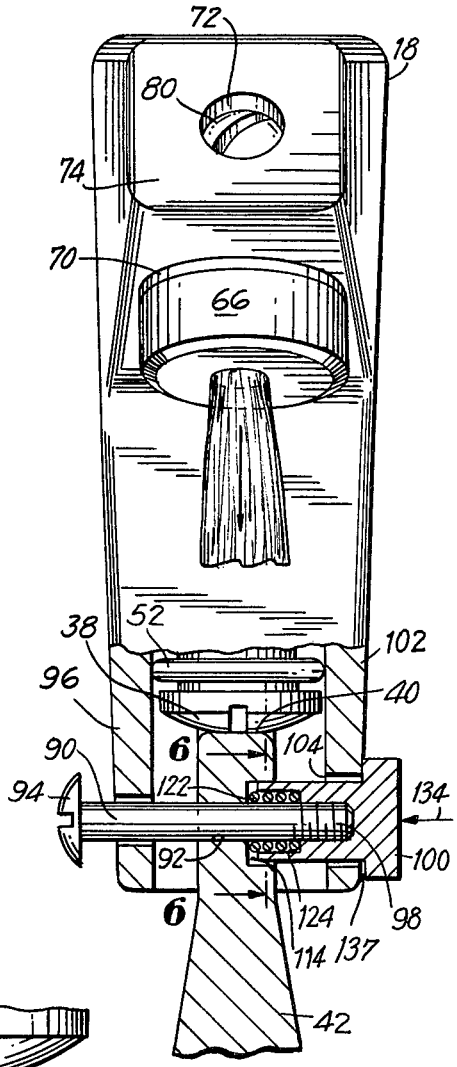
FIG. 6
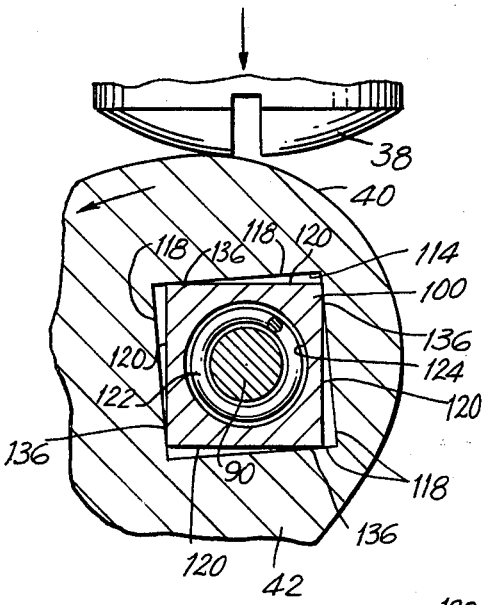
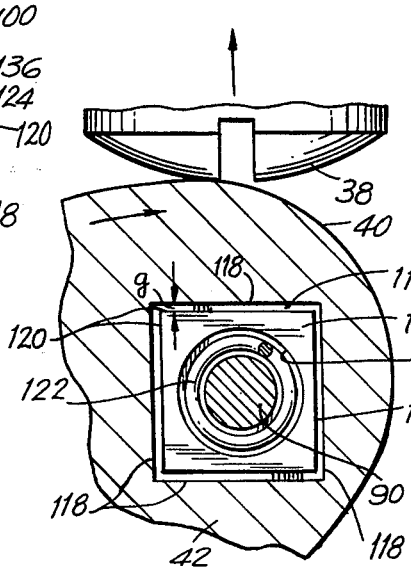
FIG. 7

WATER GLASS FILLER

BACKGROUND OF THE INVENTION

This invention relates generally to a water filler of the type used for example in restaurants, soda fountains, bars, and more particularly, to a glass filler which is operated by pressing the glass to be filled against a pivoted swing arm. In the well-known manner, the water flows so long as the glass displaces the swing arm from its rest position, and flow ceases when the glass is disengaged from the swing arm. Also, in the prior art, there are glass fillers which maintain a continuous flow of water in addition to the on-demand flow already described. Continuous flow is required when filling large containers, for example, a pitcher. The continuous flow is maintained by a continued displacement of the swing arm by the operator, or in some filler devices, the swing arm is manually moved to a third static position, where flow is continuous. This third position is entirely incompatible with on-demand operation of the device and requires two-handed operation if the container is to be simultaneously held in one hand. Termination of continuous flow also requires two hands when one hand holds the container. Spillage and overflow are not uncommon.

What is needed is a water glass filler which allows single-handed operation for either flow-on-demand or continuous flow operation. It is desired that operations be performed with a minimum amount of physical motion and that leakage of water be avoided.

SUMMARY OF THE INVENTION

Generally speaking, in accordance with the invention, a water glass filler especially suitable for single-handed operation is provided. The water glass filler according to this invention allows single-handed operation for either flow-on-demand or continuous flow operation. Manual actuation of a control button, using the same hand which concurrently holds the glass against a swing arm, changes on-demand flow into continuous flow. Continuous flow terminates on further actuation and release of the swing arm. Actuation of the control button drives a spring-loaded latch into a socket in the swing arm, and the water valve spring maintains this condition until the control button latch is released. A needle valve in the flow path allows for flow-rate adjustment to accommodate a wide range of water supply pressures.

Accordingly, it is an object of this invention to provide an improved water glass filler allowing single-handed operation for either flow-on-demand or continuous flow operation.

Another object of this invention is to provide an improved water glass filler which allows termination of continuous flow using a motion similar to that which initiates flow.

A further object of this invention is to provide an improved water glass filler which includes a flow-rate regulator.

Still another object of this invention is to provide an improved water glass filler which is placed in a continuous flow condition by pressing a button.

Yet another object of this invention is to provide an improved water glass filler which initiates continuous flow operation by pressing a button and terminates continuous flow operation by actuation of the swing arm.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a sectional view taken along line 2—2 of FIG. 1;

FIG. 5 is a view similar to FIG. 3, taken along line 5—5 of FIG. 4;

FIG. 6 is a view to a further enlarged scale taken along line 6—6 of FIG. 5; and FIG. 7 is a view similar to FIG. 6, showing the latch in condition for disengagement.

DESCRIPTION OF THE PREFERRED EMBODIMENTS

Figure 1:
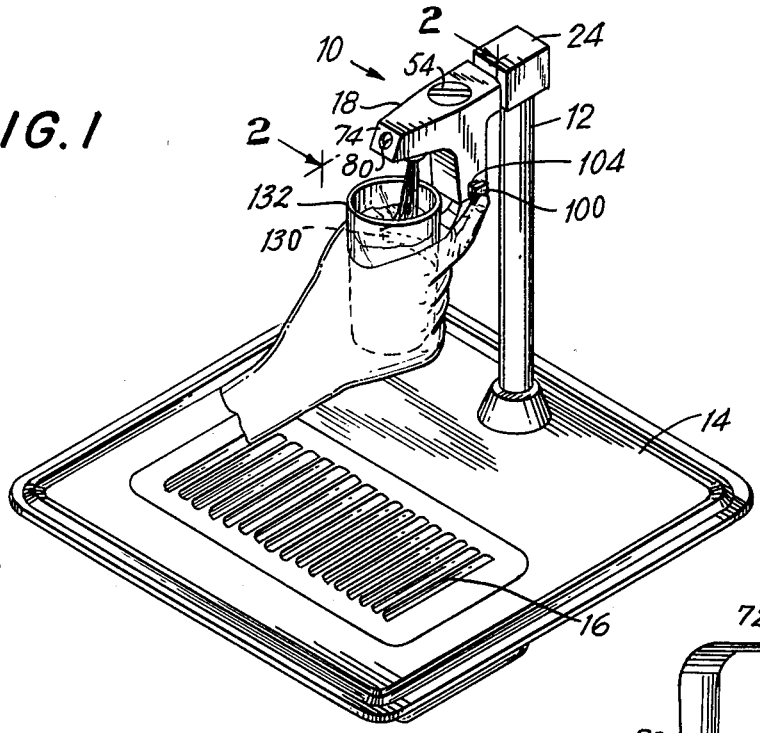
FIG. 1 is a top perspective view of the water glass filler according to this invention shown in a conventional installation.

With reference to the Figures, the water glass filler 10 according to this invention is shown mounted on a pedestal 12, by which means the filler 10 is elevated above a drain board 14 having a drip plate 16. It will be appreciated that water is delivered to the glass filler 10 from a source (not shown) through the pedestal 12, which serves as a supply pipe.

The water glass filler 10 of this invention is comprised of a body 18 including a female threaded receptacle 20 having an inlet pipe 22 connected therein. The inlet pipe 22 connects to a manifold block 24 and the pedestal 12.

A water flow valve 28 within the body 18 includes a washer 30 constrained by a washer seat 32. A bolt 34 is contained in a through hole 36 in the body 18. The upper (FIG. 2) end of the bolt 34 is threadedly engaged in the washer seat 32, and the lower end of the bolt 34 has a round head 38 which, as explained more fully hereinafter, serves as a cam follower cooperating with a cam 40 associated with a swing arm 42. A plug 44 is threadedly seated in the through hole 36, resting against a shoulder 46, and a coil spring 48 is compressed between the plug 44 and a washer 50 located adjacent the round head 38 of the bolt 34. An O-ring 52 prevents outleakage of water from the body 18 adjacent the swing arm 42. A threaded cap 54 and a flat gasket 56 seal the top of the through hole 36.

When the valve is closed, a condition not shown in the drawings, the washer 30 rests on the circular valve seat 58, which is machined into the body 18 such that water under pressure in the inlet pipe 22 and interconnecting duct 62 does not pass the valve seat 58, and there is no flow. A slot 60 in the washer seat 32 allows for a screwdriver adjustment, when the threaded cap 54 is removed, such that the washer 30 makes firm contact with the seat 58. A compressive force can be continuously exerted on the seat 58 by the washer 30 when the washer seat 32 is threaded down along the bolt 34.

The discharge duct 64 connects with the through hole 36 and leads to an aerator nozzle 66 which is threadably engaged in a partially tapped opening 68 in the underside of a protruding portion of the body 18. An aerator gear 67 within the nozzle 66 distributes flow, and a gasket 70 prevents leakage from the opening 68.

The discharge duct 64 extends axially beyond the nozzle 66 and terminates in a countersunk bore 72 opening on the front face 74 of the body 18. A needle valve 76 engages a threaded portion 78 of the extended discharge duct 64 and has a rounded, slotted head 80 recessed within the countersink 72. The other end 82 of the needle valve 76 is tapered and extends into the intersection 84 between the discharge duct 64 with the chamber 86 leading to the aerated nozzle 66. An O-ring seal 88 prevents outleakage at the counterbore 72.

It should be readily apparent that for a fixed pressure of water at the inlet pipe 22 and a fixed opening between the washer 30 and valve seat 58, the flow emanating from the aerator nozzle 66 is determined by the setting of the needle valve 76. Setting is easily performed using a screwdriver and operating on the fully accessible slotted head 80 of the needle valve 76. The recessed condition of the valve head 80 in the counterbore 72 assures that the setting will not be tampered with and people will not be subject to scratches or damage to garments which might otherwise occur if the needle valve 76 protruded from the body 18.

Figure 3:
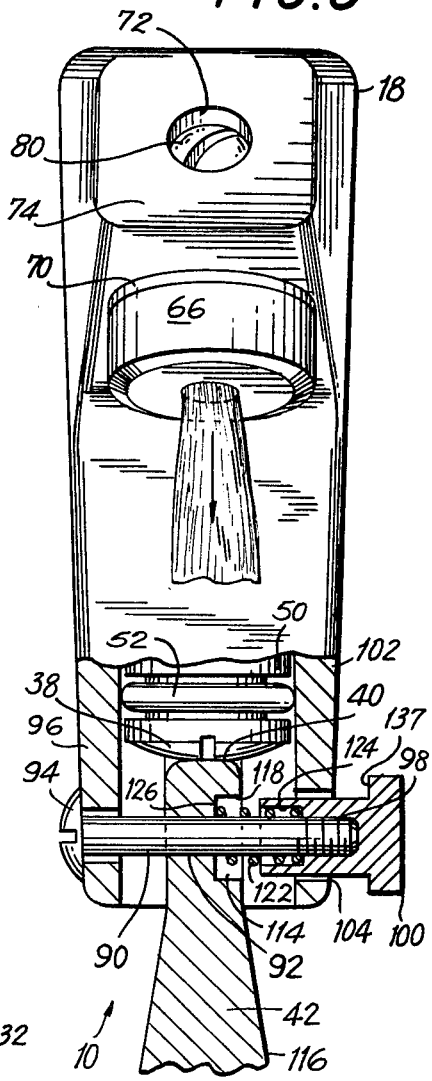
FIG. 3 is a front view to an enlarged scale, partially in section, taken along line 3—3 of FIG. 2.

As best seen in FIGS. 3 and 5, the swing arm 42 is rotatably mounted to the body 18 by suspension on the unthreaded portion of a bolt 90. The bolt 90 passes through a hole 92 in the swing arm 42 and serves as the center of rotation for the cam surface 40. The bolt 90 is suspended at the head end 94 in a lateral wall 96 of the body 18, and the threaded end 98 of the bolt 90 is threadably engaged in a control button 100 which passes through and extends from both sides of the other lateral wall 102 of the body 18. As seen in FIGS. 6 and 7, the control button 100 is square in cross section, and the opening 104 in the lateral wall 102 of the body 18 is also square such that it is not possible for the control button 100 to rotate in the opening 104. Thus, the swing arm 42 pivots about the longitudinal axes of the bolt 90, but the bolt 90 does not rotate except through a small arc, as described more fully hereinafter.

Figure 4:
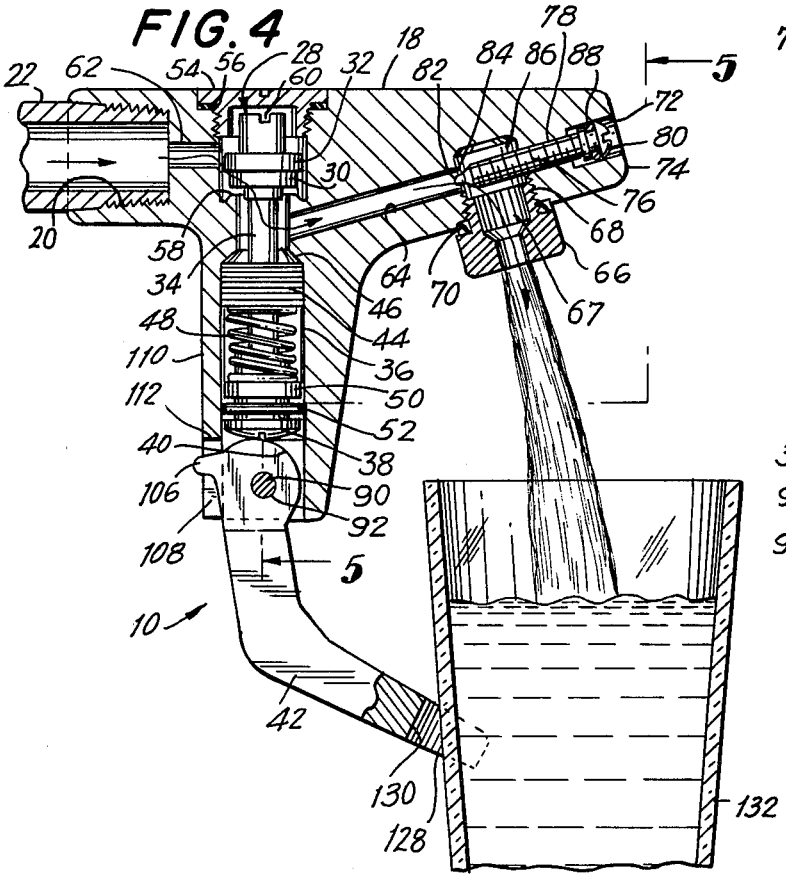
FIG. 4 is a view similar to FIG. 2, showing a continuous flow condition of operation.

The swing arm 42, as stated above, comprises the cam surface 40, which rotates with the bolt 90 as its center and engages the round head 38 of the bolt 34. The cam profile 40 is not described in detail herein, but it should be understood that pivoting the swing arm 42 in a clockwise direction from its rest position causes the bolthead 38 to move upwardly (FIGS. 2, 4 and 7) and lift the washer 30 off the valve seat 58 to permit flow of water. It will be apparent to those skilled in the art that the contour of the cam 40 can provide, as desired in design, a quick-opening valve, a late-opening valve or any of an entire range of flow rates in relation to the position of the swing arm 42. The cam portion 40 of the swing arm 42 is recessed within the through opening 36, and a stop 106 moves within a slot 108 in the rear wall 110 of the body 18. Contact between the upper surface of the stop 106 and the end wall 112 of the slot 108 provides a limit to the angular rotation of the swing arm 42 about the bolt 90.

A square socket 114 is recessed into one side 116 of the swing arm 42. The socket 114 has its lateral surfaces 118 (FIGS. 6 and 7) substantially parallel to the lateral surfaces 120 of the control button 100. When the lateral sides 118, 120 of the socket 114 and control button 100, respectively, are parallel, as shown in FIG. 7, there is a clearance g between opposed surfaces. A coil spring 122 surrounds the bolt 90 and at one end seats in a counterbore 124 in the control button 100, and at the other end presses against the rear wall 126 of the socket 114 in the swing arm 42. Normally, the compressive force of the spring 122 forces the head end 94 of the bolt 90 against the lateral wall 96 of the body 18 and keeps the control button 100 disengaged from the arm socket 114.

The swing arm 42 is forked at its free-moving end 128, and a curved surface 130 between the tines allows for the positioning of a glass 132 (FIG. 1) for filling. The swing arm 42 is proportioned so that a conventional-size glass will be centered beneath the aerator nozzle 66 when the device is operated.

Operation of the water glass filler in the flow-on-demand mode is now described. The user grasps a glass 132 to be filled and presses the glass against the curved surface 130 of the swing arm 42, pivoting the swing arm 42 in the clockwise direction (FIGS. 2 and 7). Rotation of the cam surface 40 against the bolthead 38 causes the coil spring 48 to be compressed as the bolt 34 moves upwardly, causing the washer 30 to lift from the seat 58. Water under pressure in the inlet pipe 22 flows through the interconnecting duct 62 past the washer 30 and seat 58 into the discharge duct 64 leading to the aerator nozzle 66. The water is discharged into the glass 132. When the desired quantity of water has accumulated in the glass 132, the user releases pressure on the swing arm 42 by withdrawing the glass 132 from contact with the curved surface 130. Substantially instantaneously, the compressive force exerted by the spring 48 moves the bolthead 38 downward, pivoting the swing arm 42 in a counterclockwise direction until the washer 30 rests upon the valve seat 58 to close off flow through the valve 10. As stated above, the position of the needle valve 76 can be adjusted to suit the pressure available in the inlet pipe 22 and the desired flow rate from the nozzle 66.

The continuous flow mode of operation is now described. Water discharge is initiated as described above for the flow-on-demand mode of operation. The user presses a glass 132 against the curved surface 130 of the swing arm 42, causing the swing arm 42 to pivot about the bolt 90 in a clockwise direction (FIG. 2). The bolt 34 rises due to the camming action of the surface 40 against the bolthead 38, and the washer 30 is lifted from the valve seat 58 to permit water flow from the nozzle 66. In the process of pivoting the swing arm 42 in a clockwise direction (FIG. 7), the square side surfaces 120 of the control button 100 come into substantial alignment with the square side surfaces 118 of the socket 114 in the swing arm 42. At this time, in order to initiate continuous flow, the user extends a finger (FIG. 1) on the hand holding the glass 132 and applies a force as indicated by the arrow 134 (FIG. 5) which presses the square control button 100 inside the square socket 114 of the swing arm 42. Inward motion of the control button 100 is stopped by contact of the shoulder 137 against the lateral wall 102 of the body 18. In the process, the bolthead 94 extends away from the body wall 96 and the coil spring 122 is compressed.

With a portion of the control button 100 recessed within the socket 114 of the swing arm 42, the pressure of the glass 132 against the curved surface 130 of the swing arm 42 is released, allowing the spring 48 in the valve body 18 to expand. The spring 48 drives the bolthead 38 downwardly against the cam surface 40 and causes the swing arm 42 to pivot in a counterclockwise direction (FIG. 6), whereby the substantial alignment between the lateral sides 118 of the socket 114 and the lateral sides 120 of the control button 100 is altered and the swing arm 42 wedges against the button 100, making contact at four points 136. The swing arm 42 is prevented from returning to its standby condition by the clutchlike interference with the control button 100, such that flow from the water glass filler 10 continues, and pressure on the swing arm 42 by the glass 132 is not required. Further, removal of pressure as indicated (FIG. 5) by the arrow 134 from the control button 100 does not change the position of the control button 100, which is prevented by frictional engagement at the four points 136 from any motion in the direction of the longitudinal axis of the bolt 90. Accordingly, water flows continuously from the nozzle 66, and a large container, such as a pitcher, may be filled without attention from the user, or a plurality of glasses may be filled in succession without need to actuate the swing arm 42.

To terminate the continuous flow, the swing arm 42 is pivoted again in the same direction which initiated flow, that is, in a clockwise direction as indicated in FIG. 7. In the pivoting process, the sides 120 of the control button 100 and the sides 118 of the socket 114 again become aligned (FIG. 7), and urged by the compressed spring 122 and unopposed by substantial friction between the socket walls and the control button 100, the control button is ejected and translates to the right (FIG. 5), out of engagement with the swing arm 42. Thus, the condition illustrated in FIG. 3 is restored. Now, the filler 10 is in the flow-on-demand mode, and flow is terminated by releasing the swing arm 42 and allowing the spring 48 to return the swing arm 42 to the position where the valve washer 30 seats on the valve seat 58 and terminates flow from the nozzle 66.

It should be apparent that in an alternative embodiment of this invention, the control button 100 may be provided on both ends of the bolt 90, with an additional socket 114 being provided on the opposite face of the swing arm 42 such that the control button 100 may be actuated with equal facility from either side of the device, and right-handed or left-handed filling is readily accomplished using only one hand for simultaneously holding the glass and operating the control button 100.

It should also be apparent that in an alternative embodiment of this invention, an electrical solenoid-operated valve may be used, operating in response to the position of a spring-loaded, pivoted swing arm. Pressure on the swing arms pivots the arm and actuates an electrical switch, e.g., a button switch, directly or indirectly thereby initiating flow. A control button cooperates with the swing arm as described above to selectively maintain an actuated switch and continuous flow.

Further, in an alternative embodiment of this invention, the control button and socket are not on the rotating axis of the swing arm. The bolt 90 is supported in the housing wall 102 in the same manner as it is supported in the opposite wall 96.

It will thus be seen that the objects set forth above, and those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A water glass filler comprising:

a body, said body having an inlet duct for water and a discharge duct for water;

a flow valve, said flow valve being intermediate said inlet and outlet ducts for water, a closed condition of said flow valve preventing flow from said inlet to said outlet duct, an open condition of said valve permitting flow from said inlet to said outlet duct;

movable means displacable in a first direction for opening said flow valve in response to an external force applied thereto in said first direction, and displacable in a second direction for closing said flow valve in response to the removal of said external force, whereby flow on demand is provided;

first bias means biasing said movable means in said second direction to normally close said flow means upon removal of said external force;

latching means displacable between a first unlatched position and a second position at which it is engaged by said movable means after said external force is removed while said valve is open for preventing said closing of said flow valve, whereby continuous flow is provided; and second bias means for biasing said latching means toward its first position so that upon the reapplication of said external force in said first direction to said movable means to disengage said latching means from said movable means, displacement of said latching means to its first position in response to said second bias means is permitted to free said movable means for displacement in its second direction in response to said first bias means whereby a flow-on demand mode of operation is initiated, and a continuous-flow mode of operation is terminated by similar force applications.

2. A water glass filler as claimed in claim 1, wherein said movable means for opening includes a pivoting member.

3. The water glass filler as claimed in claim 2, wherein said latching means includes an element for interlocking with a mating part, and said pivoting means includes said mating part, said locking means element and said mating part being aligned for interlocking by application of said external force to displace said pivoting member in said first direction.

4. The water glass filler as claimed in claim 3, wherein application of external pressure to said latching means element when said mating part and said latching means element are aligned displaces said latching means element to its second position to cause interlocking.

5. The water glass filler as claimed in claim 4, wherein said element for interlocking is non-circular in cross-section and said mating part having a non-circular cross-section shaped to permit engaement with said element for interlocking when the external force on said movable means is removed.

6. The water glass filler as claimed in claim 2 or 5, wherein said pivoting member is a swing arm, said socket being intergral with said swing arm, said external force being applied to said swing arm.

7. The water glass filler as claimed in claim 6, and further comprising a cam, said cam moving with said swing arm, and a cam follower cooperating with said cam, said cam follower being connected to said flow valve, the contours of said cam and follower being adapted to cause said valve to open when said external force is applied and to remain open when said locking means element and said mating part are interlocked.

8. The water glass filler as claimed in claim 7, wherein said first bias means is adapted to act on said cam follower to oppose pivoting of said swing arm by said external force, and to restore said swing arm to an unpivoted position when said external force is absent to provide on-demand flow, said return being prevented when said latching means element and said mating part are interlocked to allow continuous flow.

9. The water glass filler as claimed in claim 6, wherein the distance between said swing arm and said latching means is spannable by the fingers of one hand, whereby full operation of said filler valve is achieved using one hand.

10. The water glass filler as claimed in claim 1 or 4, and further comprising a flow regulator, said flow regulator being positioned intermediate said flow valve and said discharge duct.

11. The water glass filler as claimed in claim 10, wherein said flow regulator includes an adjustable needle valve entering and partially blocking said discharge duct, the degree of said blockage being selectively variable by adjusting the setting of said needle valve.

12. The water glass filler as claimed in claim 5, wherein the cross-sectional dimension of the socket is greater than that of the element for interlocking to permit displacement of said latching means to its second position for interlocking and, thereafter, displacement of said movable means in said second direction upon removal of the external force applied thereto to engage said element for interlocking and said socket, to prevent further movement of both said latching means and movable means and to hold said valve open.

* * * * *